United States Patent [19]

Smith

[11] 4,214,327

[45] Jul. 29, 1980

[54] BLANKET SUPPORT AND FOOTREST

[76] Inventor: Phyllis Smith, 3507 North Dr., Greenville, Ohio 45331

[21] Appl. No.: 974,027

[22] Filed: Dec. 28, 1978

[51] Int. Cl.[2] ..... A47C 21/00

[52] U.S. Cl. ..... 5/444; 5/426; 5/504

[58] Field of Search ..... 5/94, 425–427, 5/444, 503–507

[56] References Cited

U.S. PATENT DOCUMENTS

| | | | |
|---|---|---|---|
| 2,598,295 | 5/1952 | Pelton | 5/505 |
| 3,173,158 | 3/1965 | Oakes | 5/425 |
| 3,402,409 | 9/1968 | Kain | 5/426 |
| 3,808,614 | 5/1974 | Reinhard | 5/505 |
| 4,022,502 | 5/1977 | Smith et al. | 5/426 |
| 4,104,751 | 8/1978 | Churchman | 5/444 |

*Primary Examiner*—Casmir A. Nunberg

[57] ABSTRACT

A blanket support and footrest comprised of two distinct portions, namely a rigid lower portion having a bottom and a side which is substantially perpendicular to the bottom so that the lower portion of the unit has an essentially L-shaped cross section, and a flat upper portion which is hingedly mounted to the side section of the lower portion. A locking arrangement is associated with the upper and lower portions for either holding the upper portion upright, or for allowing the upper portion to be folded down toward the bottom of the unit.

6 Claims, 7 Drawing Figures

BLANKET SUPPORT AND FOOTREST

The present invention relates to a blanket support and footrest for preventing bed covers from resting on feet and/or for providing actual support to the feet themselves.

Bed covers, such as linen and blankets, create pressure on feet. This not only causes discomfort, but can actually pose a health hazard. For instance, the pressure of the bed covers over an extended period of time can cause sores on toes and heels. In addition, in the case of someone who is bedridden for a long period of time, the pressure of the bed covers can cause malformation or deformation of the feet, even permanently crippling the toes or feet. Even those people who are not bedridden experience discomfort from the pressure of the bed covers, causing them to sleep on their sides and not on their back in order to be more comfortable.

The idea of a blanket support is not new. Thus, for example, U.S. Pat. No. 3,571,828 (Bergsgaard) discloses a complicated arrangement having a slidably mounted U-shaped rod. This heretofore known blanket support is impractical for several reasons. Not only is it complicated to manufacture, but it requires numerous manipulations in order to use it. In addition, this known blanket support must be mounted to the bed frame, thus making it semi-permanent in nature. When not being used, short of removing it entirely from the bed frame, this known blanket support can only be folded flat between the mattress and springs, which requires lifting of the mattress.

Other heretofore known devices, which are actually more in the nature of foot supports, also fail to simply and adequately solve the problems presented above. Examples of these other devices are disclosed in U.S. Pat. Nos. 3,803,645 and 3,967,334. Both of these devices, although less complicated than the above-mentioned Bergsgaard patent, are still more complicated than the blanket support of the present invention, and in addition, must be mounted to the side rails of the bed, thus not making them available for universal usage, but rather limiting their use to specialized institutional beds, such as hospital beds.

It is, therefore, an object of the present invention to provide a blanket support and footrest which is easy and inexpensive to manufacture, is easy to use, can be used both in homes and in institutions, and relieves the feet of discomfort when a blanket is spread over the blanket support and person.

This object, and other objects and advantages of the present invention, will appear more clearly from the following specification in connection with the accompanying drawing, in which.

Figure 1:
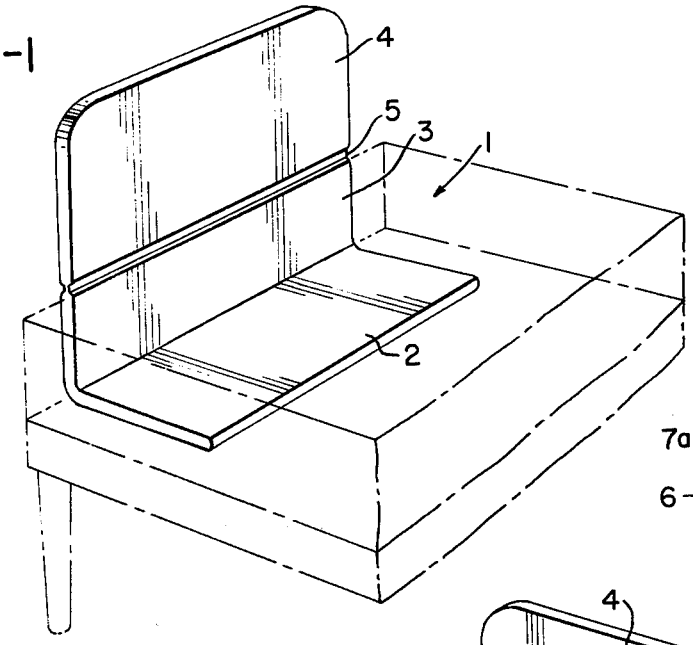
FIG. 1 shows a blanket support and footrest according to the present invention which has been inserted between the mattress and box springs of a bed and is in a locked upright position ready for use.

The blanket support and footrest of the present invention is characterized primarily by a unit comprised of two distinct portions, namely a rigid lower portion having a bottom and a side which is substantially perpendicular to the bottom, so that the lower portion of the unit has an essentially L-shaped cross section, and a flat top portion which is hingedly mounted to the side section of the lower portion. In addition, the unit also comprises means associated with the top and lower portions for either holding the top portion upright, or for allowing the top portion to be folded down toward the bottom of the unit.

Referring now to the drawing in detail, the blanket support and footrest comprises a lower portion 1 having a bottom 2 and a side 3. The side 3 is substantially perpendicular to the bottom 2, so that the lower portion 1 has an essentially L-shaped cross section. The lower portion 1 may be constructed as a single molded piece, or may comprise two separate pieces 2, 3 which are rigidly connected. In either instance, the lower portion 1 may be provided with reinforcing means of any standard type (not shown) to give it more rigidity.

A flat, top or upper portion 4 is hingedly connected to the side 3 by hinge means 5. These hinge means 5 may comprise a plastic membrane hinge, or may also comprise conventional hinges (not shown) which are connected to the side 3 and the top portion 4. One or more hinges may be used, depending upon the width of the blanket support.

Figure 3:
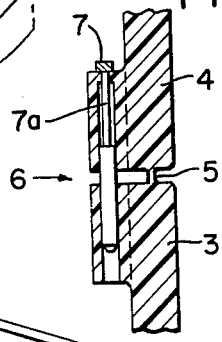
FIG. 3 is a view taken along the line III—III of FIG. 2 but on a larger scale than that of FIG. 2, and shows in section the locking arrangement for keeping the upper portion of the blanket support in an upright position.
Figure 2:
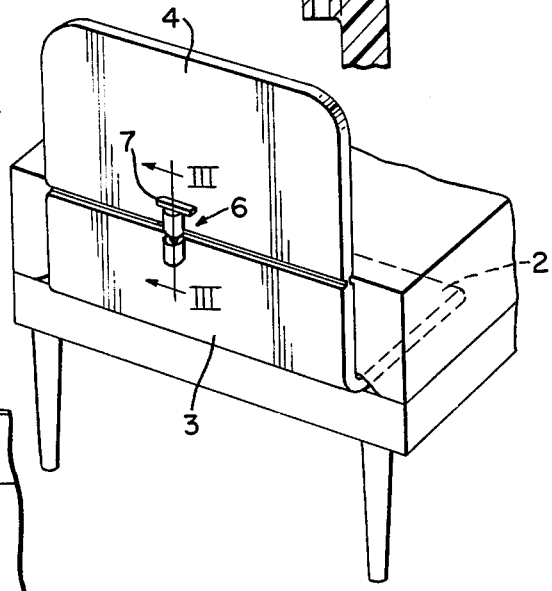
FIG. 2 shows the blanket support of FIG. 1 but from the opposite side.

FIGS. 2 and 3 clearly show how the locking means 6 hold the top portion 4 upright. In order to release the locking means 6, which are shown in the form of a captive bolt and lock arrangement, the handle 7, which is connected to a bolt **7*a*, is pulled up, and the top portion 4 is pivoted forward and downwardly toward the bottom 2 about the hinge means 5. In order to again place the upper portion 4 in an upright position, the portion 4 is lifted up until it is aligned with the side 3, and the handle 7, with the bolt 7*a*, are pushed down so as to engage the remainder of the locking means 6, thus achieving the position of the blanket support shown in FIGS. 1–4**.

Figure 4:
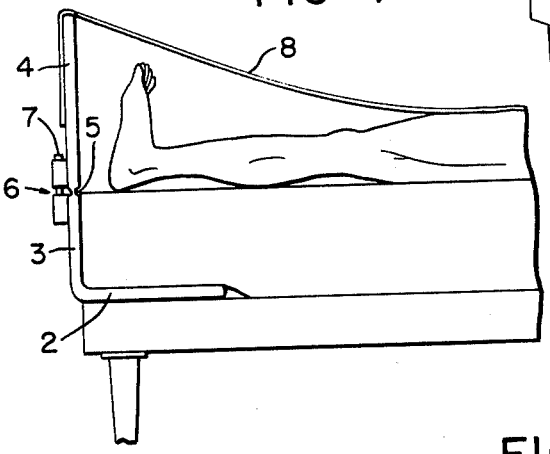
FIG. 4 shows the blanket support of the present invention in use.

FIG. 4 shows the blanket support in use, with a blanket 8 being draped over the top portion 4. The blanket 8 could also be draped further over the blanket support, so that it could be tucked in between the bottom 2 and the bed springs. In either case, it can be clearly seen that the blanket 8 is supported away from the feet of a person utilizing the blanket support of the present invention.

Figure 5:
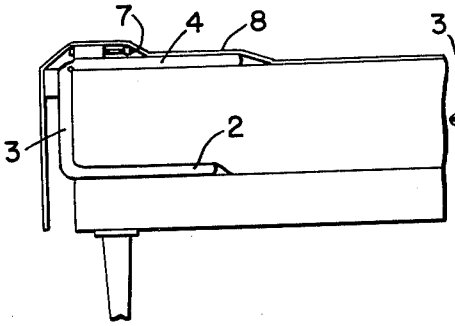
FIG. 5 shows the blanket support of the present invention with the top portion thereof folded down against a mattress when not in use and when the bed is made up.

FIG. 5 shows how the blanket support can be folded down when not in use, so that the bed can be made up. As shown, the handle 7 with its associated bolt **7*a* is pulled up, thus releasing the bolt and lock arrangement The blanket 8** covers the blanket support, making the latter hardly noticeable.

Figure 6:
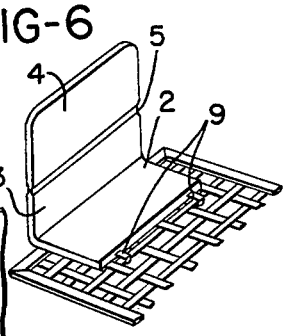
FIG. 6 shows another embodiment of the blanket support and footrest of the present invention, with hooks provided on the lower portion thereof for use with beds having exposed springs.

Pursuant to another embodiment of the invention, FIG. 6 shows a blanket support which is particularly adapted to be used for institutional beds, such as hospital beds, which have exposed bed springs, rather than box springs, upon which the mattresses are placed. In the arrangement of FIG. 6, hooks 9 are provided on the bottom 2 of the blanket support. These hooks 9 are then looped over the springs of the bed to prevent the blanket support from being kicked or pushed off the bed. These hooks 9 can either be integrally molded along with the bottom 2, or can be separately connected thereto, and can be made of any suitable material, such as metal or plastic. This embodiment is particularly helpful when the unit is to be used as a footrest.

Figure 7:
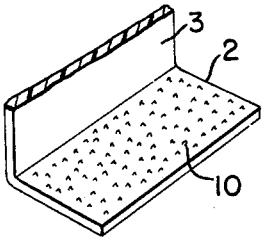
FIG. 7 shows a part of the blanket support and footrest of the present invention, with frictional material provided on the lower portion thereof.

In the embodiment shown in FIG. 7, the bottom 2 is provided with frictional material 10 in order to provide better frictional contact and therefore more securely hold the blanket support between the mattress and bed springs. Although only shown on that side of the bottom 2 which would be placed next to the mattress, the frictional material 10 may also be provided on that side of the bottom 2 which faces the box springs. This frictional material may comprise rubber, a rubberized fabric, or any other suitable material. The lower portion 1 and the top portion 4 of the blanket support of the present invention may be molded from a single piece of plastic or other synthetic material, or may be made of separate units, in which case the separate units may be made of plastic or of some other material, such as wood or even metal, which is subsequently covered by fabric. The components of the blanket support should have no sharp edges, which could catch on bed covers. If the blanket support is molded from a single piece of plastic, the hinge means 5 would comprise a plastic membrane hinge. If made of separate pieces, the top portion 4 and the side 3 of the lower portion 1 could be connected by conventional hinges. Although the locking means 6 have been illustrated as comprising a captive bolt and lock arrangement, any other suitable releasable lock arrangement may be used. Although only one locking means 6 has been illustrated, the number used depends upon the width of the blanket support.

The blanket support of the present invention has been illustrated with a single bed. It may, of course, be used with any width of mattress, such as for a double bed or a king size bed. The width of the blanket support will, of course, vary according to the width of the mattress used. Thus, for example, for a single bed the width of the blanket support might be approximately 12–18". For larger mattresses, a wider blanket support could be used, or more than one blanket support could be used. The transverse dimension of the bottom 2 is about 10", while the height of the side 3 should correspond to the thickness of the mattress, and is in the vicinity of seven inches. The height of the top portion 4 varies approximately from 8 to 12" depending upon the size and the age of the person using the blanket support. The thickness of the individual portions of the blanket support depend upon the type of material used, and the strength desired.

In contrast to the heretofore known footrests and blanket supports, which are complex, complicated to use, expensive and/or for the most part impractical, the blanket support and footrest of the present invention has the following advantages: its construction is simple, it is inexpensive to manufacture, it is easy to use, and it is very practical. In order to use the blanket support of the present invention, it is merely necessary to insert the lower portion thereof, and specifically the bottom thereof, between a mattress and bed springs at the foot of a bed. By manipulation of a simple locking arrangement, the top portion of the blanket support can either be locked into an upright position for use, or can be folded down on top of the mattress so that the bed can be made up essentially without showing any sign of the presence of the blanket support. Other than possibly hooking the bottom of the blanket support onto bed springs, there is no complicated manipulation in order to attach the blanket support to the bed. Furthermore, it is not necessary to lift up the mattress or move the blanket support, other than lowering the top portion thereof, in order to make up the bed. When it is desired to change the bed covers, the blanket support of the present invention easily pulls out from between the mattress and the bed springs.

The present invention is, of course, in no way restricted to the specific disclosure of the drawing, but also encompasses any modifications within the scope of the appended claims.

What I claim is:

1. A blanket support and footrest, which includes:
   - a lower portion comprising a bottom and a side which is rigidly connected to said bottom, and is substantially perpendicular thereto, so that said lower portion has an essentially L-shaped cross section;
   - a flat upper portion pivotally connected to said side of said lower portion; and
   - means operatively connected to said upper and lower portions for selectively
     - (a) holding said upper portion upright in alignment with said side so that said upper portion forms an extension of said side, and
     - (b) releasing said upper portion to allow same to be folded toward said side.

2. A blanket support and foot rest according to claim 1, in which said means for selectively holding and releasing said upper portion is located on those sides of said upper and lower portions which face away from said bottom, so that said upper portion, when released, is foldable toward said bottom.

3. A blanket support and footrest according to claim 1 or 2, in which said means for selectively holding and releasing said upper portion comprises a captive bolt and lock arrangement.

4. A blanket support and footrest according to claim 1, in which said upper portion and said side of said lower portion are hingedly interconnected by a plastic membrane.

5. A blanket support and footrest according to claim 2, which includes hook means connected to said bottom for engaging bed springs to more securely hold said blanket support and footrest between a mattress and bed springs.

6. A blanket support and footrest according to claim 2, in which at least a part of at least one side of said bottom is provided with frictional material for increasing the frictional contact of said bottom.

* * * * *